US007401652B2

(12) United States Patent
Matthews

(10) Patent No.: US 7,401,652 B2
(45) Date of Patent: Jul. 22, 2008

(54) MULTI-PERF FRACTURING PROCESS

(76) Inventor: H. Lee Matthews, 616 Texas St., Suite 102, Fort Worth, TX (US) 76102

( * ) Notice: Subject to any disclaimer, the term of this patent is extended or adjusted under 35 U.S.C. 154(b) by 70 days.

(21) Appl. No.: 11/414,024

(22) Filed: Apr. 28, 2006

(65) Prior Publication Data

US 2006/0243443 A1 Nov. 2, 2006

Related U.S. Application Data

(60) Provisional application No. 60/676,389, filed on Apr. 29, 2005.

(51) Int. Cl.
*E21B 43/26* (2006.01)

(52) U.S. Cl. ..... 166/308.1; 166/50; 166/297

(58) Field of Classification Search ..... 166/52, 166/254.1, 281, 284, 297, 308.1
See application file for complete search history.

(56) References Cited

U.S. PATENT DOCUMENTS

| | | | | |
|---|---|---|---|---|
| 4,850,431 | A | 7/1989 | Austin et al. | 166/308 |
| 4,893,676 | A * | 1/1990 | Hill | 166/280.1 |
| 5,323,684 | A | 6/1994 | Umphries | 89/1.15 |
| 5,785,130 | A | 7/1998 | Wesson et al. | 175/4.6 |
| 5,797,464 | A | 8/1998 | Pratt et al. | 175/4.6 |
| 5,813,463 | A | 9/1998 | Stadulis | 166/280 |
| 5,894,888 | A | 4/1999 | Wiemers et al. | 166/250.1 |
| 6,508,307 | B1 | 1/2003 | Almaguer | 166/308 |
| 6,672,405 | B2 | 1/2004 | Tolman et al. | 175/4.52 |
| 6,942,033 | B2 * | 9/2005 | Brooks et al. | 166/297 |
| 7,182,138 | B2 * | 2/2007 | Behrmann et al. | 166/311 |
| 2002/0189802 | A1 * | 12/2002 | Tolman et al. | 166/55 |
| 2005/0178551 | A1 * | 8/2005 | Tolman et al. | 166/297 |

* cited by examiner

*Primary Examiner*—Jennifer H Gay
*Assistant Examiner*—Daniel P Stephenson
(74) *Attorney, Agent, or Firm*—Charles D. Gunter, Jr.

(57) ABSTRACT

A method is shown for fracturing a subterranean formation from a deviated well bore. A plurality of spaced fracture initiation points are created in the well bore. Hydraulic pressure is applied to all of the sets of perforations at the fracture initiation points to extend a plurality of spaced fractures in the formation in directions substantially perpendicular to the deviated well bore direction. The same perforated interval in the wellbore is shot two or more times, using a conventional perforating gun in order to achieve a desired hole count over a shorter distance. The perforating technique is combined with a pumping protocol which better insures that the fracturing fluid being pumped flows more evenly through each set of perforations upon the application of hydraulic pressure rather than the majority of the fluid entering only the first perforated interval of the wellbore.

4 Claims, 3 Drawing Sheets

MULTI-PERF FRACTURING PROCESS

CROSS REFERENCE TO RELATED APPLICATIONS

The present invention claims priority from my earlier filed provisional application, Ser. No. 60/676,389, filed Apr. 29, 2005, entitled "Multi-Perf Fracturing Process."

BACKGROUND OF THE INVENTION

1. Field of the Invention

The present invention relates in general to the completion of oil and gas wells and, in particular, to perforation and fracturing processes which are performed during completion operations.

2. Description of the Prior Art

In drilling operations for the production of oil and gas deposits, operators strive to maximize both the rate of flow and the overall capacity of hydrocarbon from the subsurface formation to the surface where it can be recovered. Various stimulation techniques have been developed, one of the most commercially successful techniques being referred to as "hydraulic fracturing". The rate of flow or production of hydrocarbon from a geologic formation is naturally dependent on numerous factors. One of the most obvious of these factors is the radius of the borehole; as the radius of the borehole increases, the production rate increases, generally speaking. A related factor is the number and quality of the flow paths from the formation to the borehole available to the migrating hydrocarbon. A fracture or large crack within the producing zone of the geologic formation, originating from and radiating out from the wellbore, serves to increase the effective wellbore radius. The end result is that the producing well behaves as if the entire wellbore radius were increased significantly.

The hydraulic fracturing process involves targeting a portion of the strata surrounding the wellbore and injecting a specialized fluid into the wellbore at pressures sufficient to initiate and extend a fracture into the formation. The fluid which is injected through the wellbore typically exits through holes which are formed in the cemented well casing using a special tool known as a perforating gun. However, sometimes wells are completed with no casing and therefore no perforations exist so that fluid is injected through the wellbore and directly to the formation face. Whether the well is cased or uncased, what is usually created by this process is not a single fracture, but a fracture zone, i.e., a zone having multiple fractures, or cracks in the formation, through which hydrocarbon fluids can flow to the wellbore and be produced at the surface. These fractures are extended by continued pumping and are either propped open with sand or other propping agents, or the fracture faces are etched by a reactive fluid such as an acid, or both. These techniques allow hydrocarbons contained in the formation to more readily flow to the fractures to the well bore. The artificially created fractures may be complimented by naturally existing fractures, or by fractures caused by previous or simultaneous stimulation operations in the same or nearby formations. The quality of the fracturing operation obviously has a great effect on the overall success or failure of the well production.

When fractures are created from a substantially vertical well bore penetrating the formation, there are often only two vertical fracture wings which are produced. Because these conditions have generally been viewed as less than optimum for hydrocarbon production, techniques have been developed to maximize the number of fractures created in the subterranean formation in both vertical and deviated wellbores. Because a larger number of fractures are being created, the interval or distance being stimulated is also generally increased. For example, U.S. Pat. No. 3,835,928 discloses a method of forming a plurality of vertically disposed spaced fractures from a deviated well bore penetrating a formation. A deviated well bore is drilled in a direction transverse to a known preferred fracture orientation and spaced fracture initiation points are created in the deviated well bore. Spaced vertical fractures are produced in the formation by separately creating and extending a fracture from each fracture initiation point.

U.S. Pat. No. 4,850,431 has as its object to create a plurality of spaced, substantially parallel fractures from a deviated wellbore. The in situ least principal stress direction of the formation is first determined. A predetermined number and size of perforations are then created in the casing at spaced fracture initiation points. In the preferred technique, each set of perforations is isolated and hydraulic pressure is applied to open the perforations and initiate fracturing.

One problem with the prior art fracturing techniques which Applicant's invention is intended to address is based partly upon the realization that increasing the number of fractures available to accept fracturing fluid and/or increasing the distance or interval being treated might actually work at cross purposes to the stated objective of achieving the greatest degree of hydrocarbon production. This can be explained, at least in part, because a greater number of fractures over a larger formation distance provides an increased possibility that all or most of the fracturing fluid will enter only the first or first few perforated intervals rather than being spread evenly across all the desired perforated intervals.

One deficiency in the prior art techniques therefore involves the type of perforating technique employed. The previously described references and others teach techniques for creating, for example, three or more perforated intervals in a given wellbore, each perforated interval having a given predetermined perforation shot count. In the charge carrier of a conventional perforating gun, the charges are spaced at, for example, a 60 degrees phasing and at a vertical distance of about 2 inches. Such a conventional configuration results in a shot density of 6 shots per foot using a 3⅜ inch gun in a 5½ inch casing. To achieve a higher shot count, for example 60 holes, the perforation interval would have to be on the order of 10 feet. A number of references in the perforating gun arts are directed to methods and apparatus for maximizing the number and size of holes created in the well casing which serve as fracture initiation points. However, none of these references, to Applicant's knowledge, teach the advantage of limiting the formation distance or interval being shot.

U.S. Pat. No. 5,323,684 shows an explosive carrier in which the explosive charges are mounted in a unique staggered spiral pattern which allows a greater number of shots that can be fired per unit length while increasing the spacing between explosive charges. The increased spacing of the charges is said to reduce the potential interference between fired shots, thereby providing a greater perforated hole size. However, specialized charge arrangements while achieving a greater shot density, sometimes fail to penetrate as deeply into the surrounding formation as compared to traditional off the shelf guns.

Despite the advances which have been made in the perforating and fracturing technologies of the type described above, a need continues to exist for further improvements which will result in even greater hydrocarbon production.

A need exists for improved techniques which will better insure that the fracturing fluid being pumped will flow more evenly through each set of perforations upon the application of hydraulic pressure, rather than the majority of the fluid entering only the first perforated interval of the wellbore.

A need exists for an improved fracturing technique which allows a predetermined target flow rate to be achieved early on in the pumping operation which flow rate creates a desired backpressure at the perforated intervals in the wellbore, whereby the fracturing fluid more evenly penetrates each perforated interval of the wellbore.

SUMMARY OF THE INVENTION

The present invention combines various of the above described perforating and fracturing technologies which, when combined, produce unexpectedly superior results—as evidenced by results obtained in an actual case study, which will be discussed in the detailed description of the invention which follows.

The method of the invention has produced successful completions in wells being drilled in hard, tight rock formations such as the Barnett, Woodford, Caney, Floyd and Fayetteville shales, where other prior art techniques have only produced intermittent success.

In the method of the present invention, a plurality of spaced fractures are formed in a subterranean formation from a deviated well bore. In a typical completion operation, a substantially vertical well bore is first drilled into the formation. A deviated well bore is next drilled from the substantially vertical well bore into the formation at the angle. Casing is placed and preferably cemented in the deviated well bore. A plurality of spaced fracture initiation points are created in the well bore by forming a set of perforations of a predetermined number and size through the casing into the formation at the location of each of the fracture initiation points. The predetermined number and size of the perforations at the fracture initiation points are such that a limited known flow rate of fracturing fluid will flow through each set of perforations upon the application of hydraulic pressure. Hydraulic pressure is applied to all of the sets of perforations at the fracture initiation points to thereby simultaneously extend a plurality of spaced fractures in the formation in directions substantially perpendicular to the deviated well bore direction. Propping agent can be deposited in the fractures in order to prop the fractures open. The fracture faces can also be etched by contacting them with a reactive fluid to form flow channels therein.

One aspect of Applicant's invention involves the discovery that, for horizontal wells, a tight perforating window is actually an advantage. Applicant's findings indicate that the wider the perforation spacing or "window", the greater the propensity for fractures to compete with one another. By reducing the perforation interval width, Applicant is able to consolidate the forces acting on the formation to achieve more efficient fracturing.

According to one teaching of the present invention, the same perforated interval in the wellbore is shot two or more times, using a conventional perforating gun in order to achieve a desired hole count over a shorter distance than was typical of the prior art techniques. In other words, the distance between the first and final perforated interval is minimized. Thus, a 3⅜ inch gun with 60° phasing capable of 6 shots per foot would be used to shoot the same interval twice to achieve, for example, 20 holes over 1.8 feet.

The previously described technique for achieving a shorter perforated interval is combined with a special pumping protocol which better insures that the fracturing fluid being pumped flows more evenly through each set of perforations upon the application of hydraulic pressure rather than the majority of the fluid entering only the first perforated interval of the wellbore. The perforating operation and fracturing protocol allow a predetermined target flow rate to be achieved early on in the pumping operation which flow rate creates a desired backpressure at the perforated intervals in the wellbore, whereby the fracturing fluid more evenly penetrates each perforated interval of the wellbore.

Additional objects, features and advantages will be apparent in the written description which follows.

DETAILED DESCRIPTION OF THE INVENTION

Figure 1:
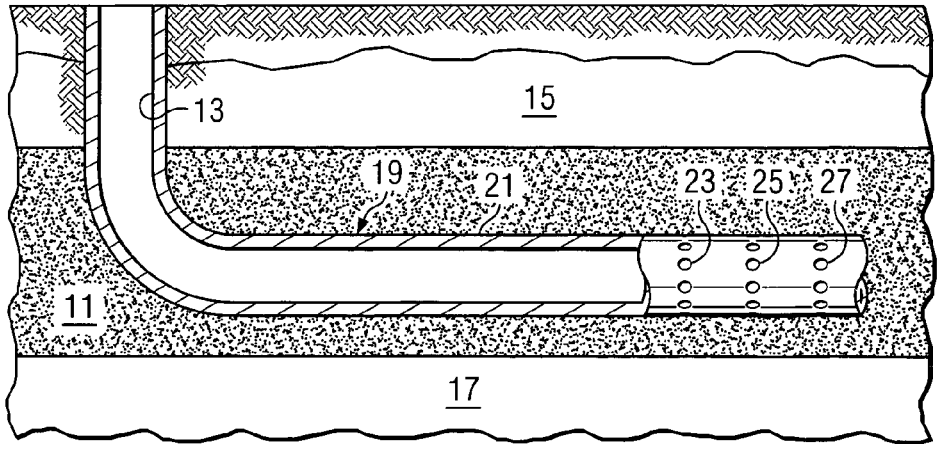
FIG. 1 is a simplified schematic view of a deviated well bore showing one perforated interval with three sets of perforations.

The present invention provides an improved method of forming spaced fractures in a subterranean zone made up of one or more subterranean formations penetrated by a horizontal well bore. By "subterranean formation" is meant an entire subterranean rock formation bounded by formations formed of dissimilar rock materials or a hydrocarbon containing zone dispose within a larger rock formation. By a "horizontal well bore" is meant a well bore which penetrates one or more subterranean formations and is deviated from the vertical.

The optimum results of creating multiple fractures in a horizontal wellbore require that all of the perforated intervals in a single fracture stimulation stage are opened and initiated at the very beginning of the process. If a specific perforated interval is not opened at the very beginning of the process, it becomes increasingly difficult to open as the net stress created by the offset fractures increase. The primary factors that affect fracture initiation are the rock properties at the perforation zone including Young's Modulus and Poisson's Ratio which describe the rock strength, the brittleness of the rock, the width of the perforated interval, the amount of pressure applied to the perforated interval, the depth of the perforation tunnel and the ability of the fluid to penetrate the perforation tunnels and the near-wellbore rock material. Fracture initiation is critical to the quality of the well in that it is necessary to create reservoir communication with the wellbore in that region of the formation. This invention addresses two major challenges in the fracture initiation process:

(1) Multiple competing fractures: the invention minimizes the width of the fracture initiation point to reduce the number of competing fractures. The greater the number of fractures that pre-exist in the perforation interval, whether natural or drilling induced, when the fracture stimulation treatment is begun, the greater the competition between the fractures to gain sufficient width to receive the fracturing fluid. This competition results in higher pressure as the fractures in close proximity push against each other. In some cases, the pressure can be so high that no sand or very little sand can be pumped due to the narrow fracture widths of the multiple, competing fractures. By making the fracture initiation interval as narrow as possible yet with sufficient perforation area to accommodate the desired flow rate required to stimulate that portion of the reservoir, the effects of multiple fractures are minimized.

The brittleness of the rock affects the number of fractures created at the beginning of the fracture stimulation process. Greater brittleness causes more fractures and the same high treating pressure results as when multiple fractures pre-exist. The proposed invention provides the greatest opportunity to initiate all of the perforated intervals at the beginning of the treatment by using deep-penetrating, high performance perforating charges which can only be loaded to six shots per foot. These charges provide the necessary perforation tunnel length required to achieve fracture initiation in hard, tight rock formations such as the Barnett, Woodford, Caney, Floyd and Fayetteville shales.

Additionally, this invention describes the key elements of the fracture initiation process which applies to all horizontal, hydraulically stimulated completions. The width of the perforated interval is the key issue at hand and recognizing its impact on fracture initiation is an essential part of the improved technique that this invention describes. The use of multiple shot densities are required in rock formations that are extremely brittle and have an even larger number of competing fractures near the wellbore.

(2) Fluid penetration: the invention improves the process of initiating fractures at each perforation interval by applying acid in stages spaced out with water to allow the pump rate to be increased after each acid slug is pumped through a set of perforations. The higher pump rate increases the differential pressure across the perforation intervals that are not yet open and helps direct the next slug of acid to those perforations. The acid cleans up the cement and calcite mineral in the perforation tunnels and allows the fluid to fully penetrate into the formation. This is very important in delivering the hydraulic energy to the face of the formation which is at 90 degrees to the orientation of the wellbore. The acid stages are beneficial in increasing the consistency and reliability of fracture initiation at all of the perforation intervals by clearing a path to the formation face and conveying the hydraulic energy to the fracture initiation point.

The method of the invention will now be described with reference to the accompanying drawings. Turning first to FIG. 1, a typical hydrocarbon containing subterranean formation 11 is shown in which a substantially vertical, cased well bore 13 has been drilled and cemented. In the example shown, the formation 11 is bounded by an upper formation 15 and a lower formation 17 formed of dissimilar rock materials. While the present inventive method may be employed in a variety of situations, it has been found to be particularly effective in stimulating the Barnett Shale region of Texas and similar hard, tight rock formations. The Barnett Shale region has particular concentrations of calcite which must be considered in the treatment regimen, as well as cement and mud damage in the case of particular wells being treated.

The well bore 13 is thus drilled and completed using conventional practices familiar to those skilled in the relevant arts. According to present day practice, it is usually customary to determine the minimum and maximum stress planes in the formation 11 of interest, as well as the surrounding formations. Suitable techniques for determining the relevant stress planes will be familiar to those skilled in the well drilling arts. These techniques include open hole logging, dipole sonic imaging, ultrasonic borehole imaging, vertical seismic profiling, formation micro-imaging, and the like.

Logging techniques can also be used to measure the permeability and other characteristics of the formation 11. Based on such measurements, the depth of a zone containing producible fluids can be determined. The desired or preferred fracture plane in the formation 11 can also be determined. The preferred fracture plane maybe generally in the direction of maximum horizontal stresses in the formation; however, is will be understood that a desired fracture plane may also be aligned at some predetermined angle with respect to the minimum or maximum stress plane. Once a desired fracture plane is known, perforating equipment may be lowered into the wellbore to create perforations that are aligned with the desired plane.

Additional test procedures are conventionally used to determine the properties of the rock material making up the formation 11. In addition to information about the stress planes of the formation of interest, other information such as the hydraulic pressure required to fracture the formation, the fracture closure pressure and the fracture extension pressure are determined. Using such information, the optimum conditions for fracturing the formation can be predetermined. This allows the operator to determine the optimum type of fracturing fluid to be used and the fracturing fluid characteristics required, the fracturing fluid pumping rate required, the depth, angle and direction of the deviated well bore to be drilled, the spacing of the fracture initiation points in the well bore, the size and number of perforations required at each initiation point, and other conditions.

Figure 5A:
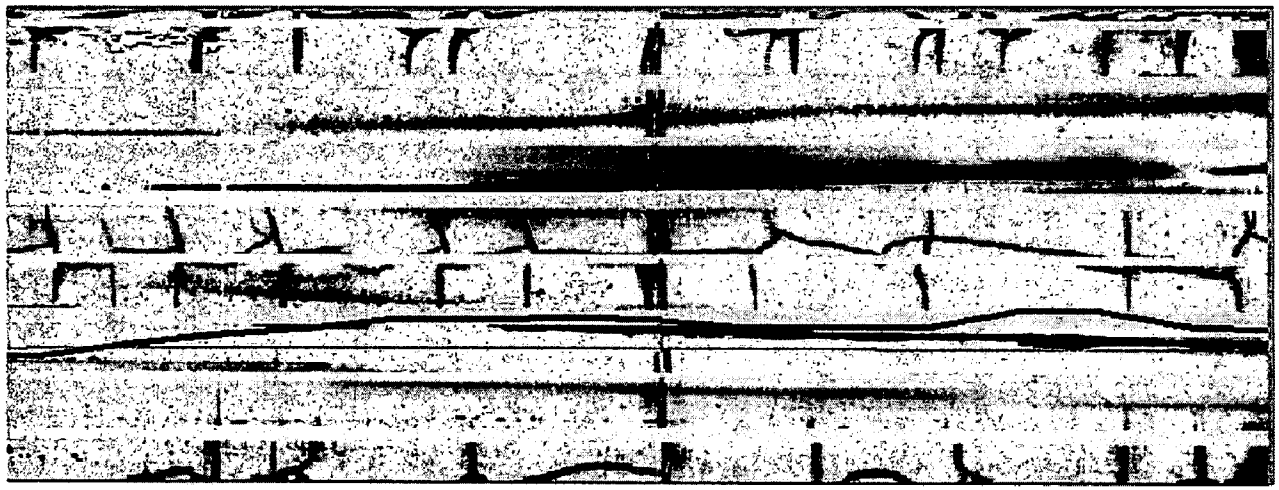
FIG. 5A is a lateral hole section of a well borehole showing a relatively low natural fracture density.
Figure 5B:
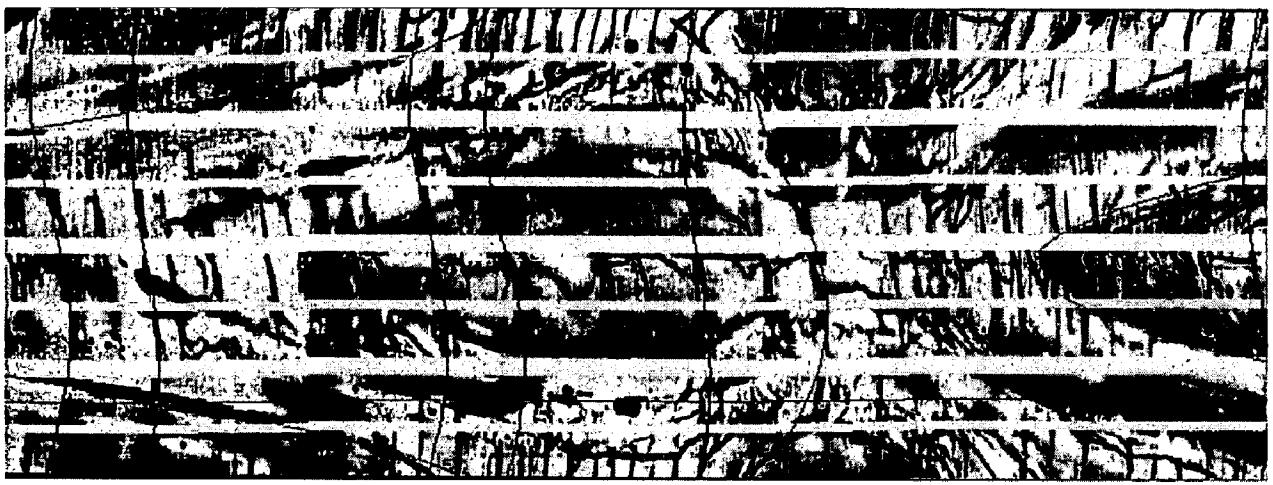
FIG. 5B is a lateral section similar to FIG. 5A, but showing a relatively high natural fracture density.

FIGS. 5A and 5B illustrate a lateral section of a typical well borehole showing in FIG. 5A a relatively low natural fracture density and in FIG. 5B a relatively high natural fracture density which exist once drilling is completed. It will be appreciated that in hydraulically fracturing the same length or "interval" of rock, that in the case of FIG. 5A relatively few fractures will be initiated, while in the case of FIG. 5B a relatively larger number of fractures will likely be initiated or extended. The method of Applicant's invention is intended to address either of these situations, and particularly to address the case illustrated in FIG. 5B in which a number of natural fractures exist in the lateral section being treated.

The methods of the present invention have particular application to horizontal or deviated well bores. Thus, with reference to FIG. 1, once the vertical well bore 13 has been drilled and the initial logging and other testing procedures have been carried out, a lower portion of the substantially vertical well bore 13 is filled with cement or otherwise plugged back to a level above the formation 13. As shown in FIG. 1, a section of deviated well bore 19 is then drilled from the upper portion of the substantially vertical well bore 12 into the formation 13 at an angle and in a direction corresponding to the information previously obtained regarding the properties of the subterranean formation of interest. In the example illustrated in FIG. 1, the lateral or deviated portion of the wellbore is generally in a transverse orientation with respect to the vertical portion of the wellbore. Upon completing the drilling of the deviated well bore 19, casing is placed and cemented in the usual manner familiar to those skilled in the drilling arts.

The number and spacing of the fractures to be formed in the subterranean formation 11 as well as the particular positioning of the deviated well bore therein between the top and bottom thereof are predetermined using the information derived from the initial fracturing and testing procedures previously described. The spacing and number of the perforations in the well casing, length of fractures and other aspects of the fractures to be formed in the formation 11 are designed so that the maximum production of hydrocarbons from the formation will be obtained.

In order to produce fractures extending from the well bore 19 after the casing 21 has been set, a plurality of sets of perforations 23, 25, 27 of a predetermined number and size are created at fracture initiation points spaced along the casing 21. The perforation sets 23, 25, 27 extend through the casing, through the surrounding cement sheath, and into the formation 11. The particular number and size of the perforations, and particularly the spacing of the perforations, at each perforation interval are predetermined and are a critical component of the present inventive method. Applicant's inventive method includes, as one aspect, the provision of the desired perforation hole count over a shorter distance or "window" than was typical of the prior art. One way to achieve this object is to use what Applicant refers to as a "multi-perf" technique. Whereas previous perforating techniques tended to produce a smaller shot count over a longer distance of the wellbore, the present inventive technique utilizes the "multi-perf" technique to provide a higher shot count over a shorter perforation distance or interval.

The multi-perf technique helps to insure that only a limited but known flow rate of fracturing fluid will flow through the each set of perforations at each fracture initiation point upon the application of hydraulic pressure. As a result, the majority of the fracturing fluid is not lost at the first set of perforations. The particular perforating technique utilized, along with a particular pumping protocol has been found to create a "back pressure" which restricts the flow rate of fracturing fluid into the various sets of perforations. This, in turn, causes fracturing fluid to flow through each of the sets of perforations formed at the various perforation intervals at a known flow rate which produces and extends a higher quality fracture therefrom.

The preferred perforating technique of the invention utilizes a conventional perforating gun rather than using special purpose "spiral" or other type designs which are intended to increase shot density. For example in a 5½ inch casing, a 3⅜ inch gun with 60 degree phasing capable of 6 shots per foot might be utilized. For 7 inch casing, a 4½ inch gun capable of 5 shots per foot might be utilized. In the case of the present inventive method, however, the gun is shot twice over the same interval to achieve an increased shot density over a small distance or interval. For example, in the case of the 3⅜ inch gun, shooting the same interval twice might achieve a shot density on the order of 20 holes over a distance of 1.8 feet.

The multi-perf operation can be carried out in various ways. One way to achieve the objective of the invention would be to shoot the target interval, pull the gun to the surface and reload, followed by lowering the gun and reshooting the interval. However, safety can be of concern on multiple trip operations. Further, because the carrier must be lowered twice, this increase the possibility that the carrier might become stuck in the borehole. Multiple trips also consume significant time which increases the expense of the operation.

As a result, Applicant's multiple density perforating is preferably carried out by placing multiple guns on a singe tubing conveyed perforating string or on a coil tubing string. For example, the tubing string can be positioned and an "A" string of guns can be shot. After, for example, a 15 second delay, the string is then moved a calculated distance and the same interval is shot again using "B" string guns providing, in effect, a double density of shots over the interval of interest. This might double the shot density from the more traditional 6 shots per foot to, for example, 12 shots per foot. At the same time, the fracturing interval is being condensed down from, for example,5-10 feet down to 2 feet.

Once the desired perforated intervals have been established, hydraulic pressure is applied to the formation 11 by way of all of the sets of perforations 23, 25, 27 whereby fractures are simultaneously extended from the initiation points into the formation 11. The application of hydraulic pressure to the formation 11 by way of the sets of perforations 23, 25, 27 involves pumping a fracturing fluid into the well bore at a rate and pressure and for a time sufficient to cause fracturing fluid to flow through the sets of perforations and to extend the fractures a predetermined distance from the well bore within the formation 11 and deposit propping agent in the fractures or etch flow channels in the fracture faces.

Figure 2:
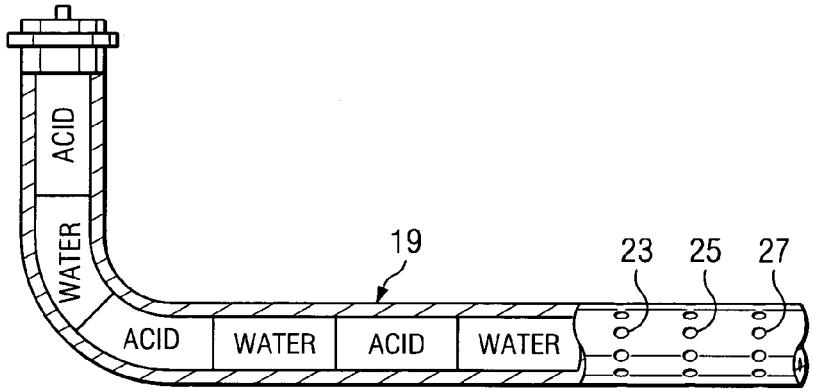
FIG. 2 is a simplified view of the pumping protocol used in the method of the invention.

FIG. 2 shows a preferred pumping protocol which has been used successfully with the above described perforating scheme of the invention. The fracturing protocol of the invention typically involves pumping a suitable acid, such as 15% HCL, in stages. The use of an aqueous acid stimulation fluid is based primarily upon the presence of calcite formations in the Barnett Shale region being drilled. As illustrated in FIG. 2, for three perforation intervals 23, 25, 27, the treatment protocol typically involves three slugs of acid with a water spacer in between each slug. A typical job might involve, for example, three acid slugs of 1500-2000 gallons each, separated by 6500 gallons of water as spacers.

To illustrate the pumping protocol in simplified fashion, assume four sets of perforations in a perforated horizontal well interval of a known casing size. This will generally dictate a minimum of four slugs of acid. The volume of the casing from the well head to the first set of perforations is first calculated in the known manner. Assume that this calculation indicates that 10,000 gallons of fluid would be required to fill the casing to the first set of perforations. As a simplified example, a preferred pumping protocol would involve pumping five 1,000 gallon slugs of acid spaced apart by five 1,000 gallon slugs of water. An actual case study follows.

Applicant's combined techniques shorten the fracture interval and compress the points of entry into the formation to be over a smaller interval, rather than over a larger interval. The compressed perforation intervals result in a greater pressure drop across the particular perforated interval being treated. The result has been found to be a more equal flow of fracturing fluid into each set of perforations.

Figure 3:
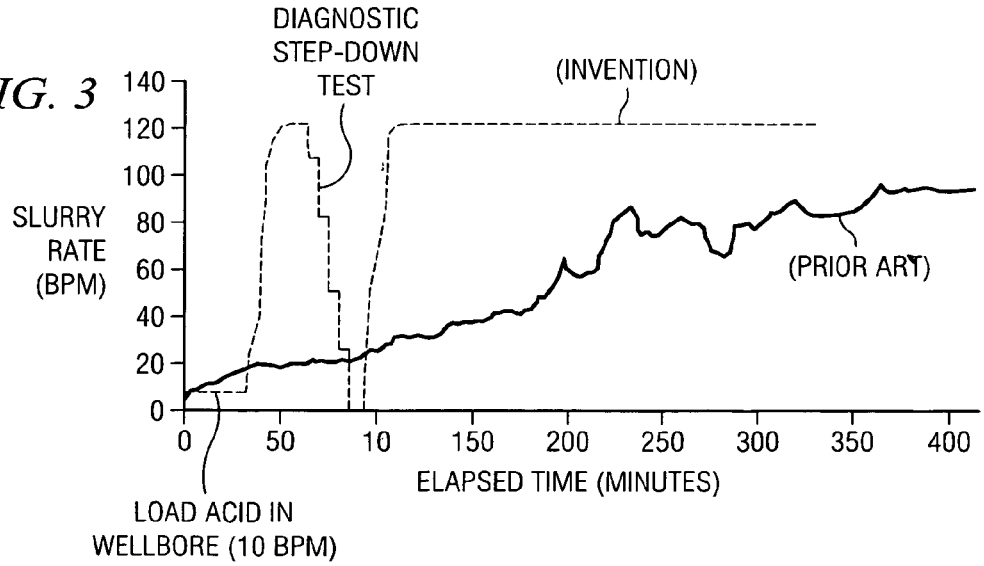
FIG. 3 is a simplified graph of slurry rate versus elapsed time showing, in exaggerated fashion, the flow rates achieved by the method of the invention as compared to a typical prior art technique.

Additionally, it is important for the purposes of the present invention that the pumping flow rate be brought up as quickly as possible in the pumping operation. FIG. 3, is a simplified graph of slurry rate versus elapsed time showing, in exaggerated fashion, the desired flow rate achieved by Applicant's technique as compared to the prior art flow rate. Applicant achieves, for example, 100-120 barrels per minute early on in the pumping operation (as in 5-30 minutes in the graph). The maximum pumping pressure limit is determined by the type and size of the casing, the nature of the formation, economics of the job, etc. For example, for a horizontal well cemented with 5½ inch 17 lb/ft N-80 casing, the maximum pressure limit is approximately 6000 psi. By bringing up the flow rate more quickly while staying within the maximum pressure limit, more nearly all of the fracturing fluid is accepted into the perforations. In other words, Applicant's technique is designed to get the maximum flow rate in the minimum amount of time to achieve a maximum differential pressure across all of the perforated intervals.

Figure 4:
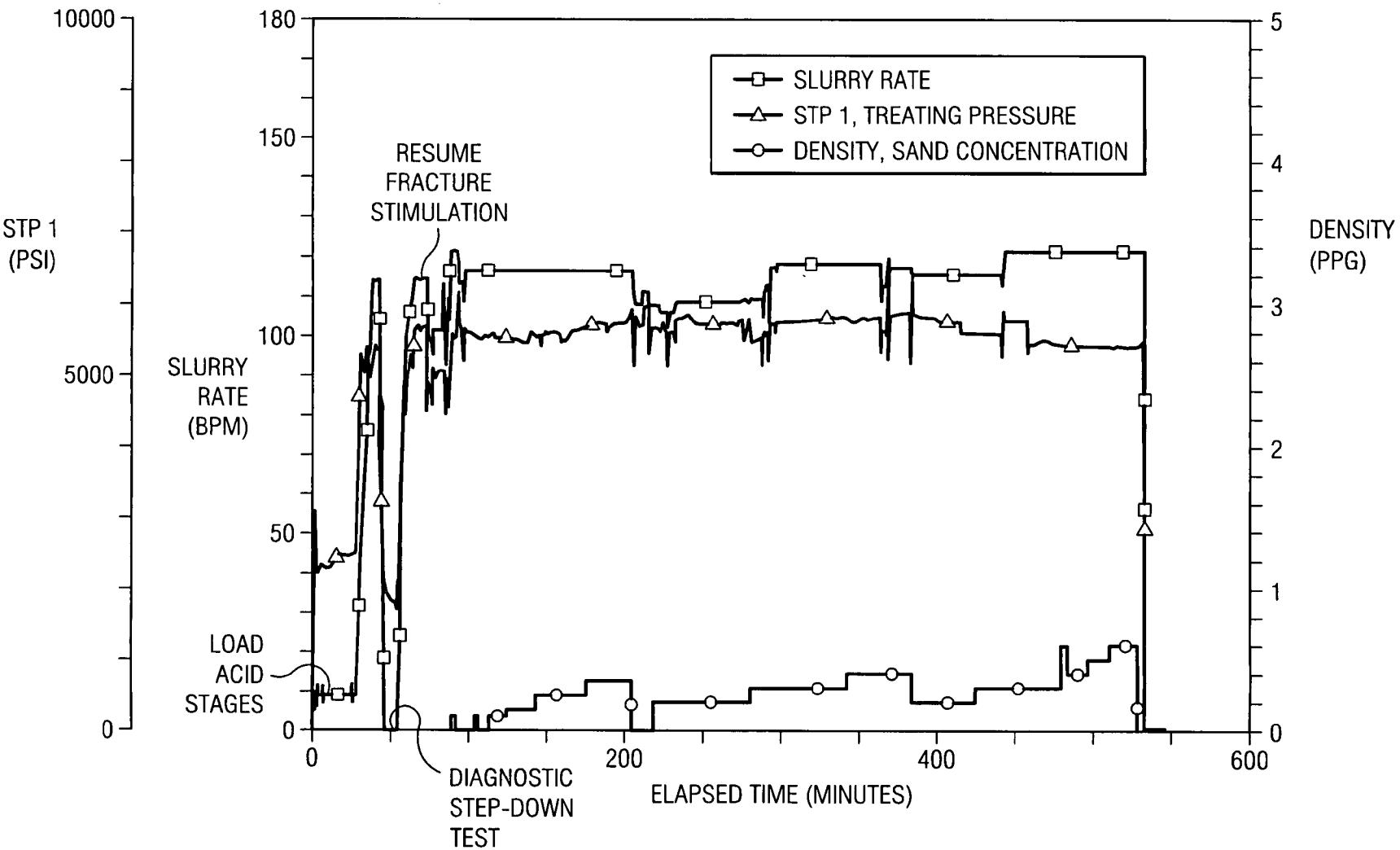
FIG. 4 is a graph of slurry rate and pump pressure versus elapsed time taken from an actual horizontal well case history.

FIG. 4 is a graph of slurry rate, pump pressure and density versus elapsed time for the first stage of an actual horizontal well case history. Note the short time interval for the slurry pump rate to reach approximately 120 BPM at the maximum pressure limit of approximately 6500 psi.

In actual case studies, Applicant's combined techniques of (1) narrowing the perforation interval; and (2) placement of the acid in the casing according to a particular protocol has achieved surprisingly consistent results in the Barnett, Woodford, Caney, Floyd and Fayetteville Shale regions.

In order to further illustrate the present invention, the following example is taken from an actual case study. The well in question was completed in the Barnett Shale region of Johnson County, Tex., during Jul. 21-Aug. 2, 2004:

EXAMPLE

The subject well was drilled to 9414' (MD) and completed with 67 joints 5½" 17# N-80 BTC premium connections set from 9414' (KB) to 6416' and 146 joints 5½" 17# N-80 LTC casing set from 6416' to surface. A float collar (PBTD) is located at 9367'. The horizontal lateral was displaced with fresh water treated with biocide @ 0.4 gal/1000 gals, 1000 gals of "Mud Clean III", 10 bbls fresh water spacer, 2000 gals Sure-Bond and cemented with 345 sacks of lead slurry (Fort Worth Basin Premium+0.1% R-3) mixed at 13.0 ppg yielding 1.65 cu.ft./sack followed by 695 sacks of tail slurry (Class "H"+0.25% R-3+0.25% FL-52+0.2% SMS) mixed at 14.4 ppg yielding 1.28 cu.ft/sack. The cement was displaced with the top plug and 217 bbls of treated water.

The casing string was milled and cleaned of cement and dope residue. The wellbore was then displaced with treated water spacer, gel swept and treated with biocide. The casing was then pressure tested to 6000 psi surface pressure with biocide treated fresh water. After logging from ~6800 feet to the surface casing, a 7 1/16", 5000 psi full-opening frac valve was installed and tested to 5000 psig.

Baker Atlas Tubing Conveyed Perforating Guns were then run into the hole. The 3⅜" casing guns were loaded with Baker's Predator charges at 6JSPF in six gun carriers for double-density shots generating 12 JSPF (22 gm charge, 0.47" EHD, 34" penetration) on 2⅜" 4.7# J-55 tubing horizontal lateral was perforated at the following intervals with two guns each:

| | | |
|---|---|---|
| 9300-02' | 12 JSPF | 20 holes |
| 9030-32' | 12 JSPF | 20 holes |
| 8765-67' | 12 JSPF | 20 holes |
| | Total holes | 60 holes |

After moving the tractor and perforating guns, the rig tree was assembled and tested to 5000 psig. The fracturing equipment and wellhead isolation tool was rigged up and prepared to frac down the 5½" casing at 130 BPM as recommended in the pumping procedure which follows, using high rate surface lines with dual blenders. A flush frac was run to the bottom perfs and the well was shut in. The well was not flowed back, however.

Six 3⅜" casing guns switched for six detonations over three perf clusters (two per cluster) and loaded with Baker's Predator charges at 6JSPF for double-density shots generating 12 JSPF (22 gm charge, 0.47" EHD, 34" penetration) were then run on wireline tractor system. The frac plug was set at 8600 feet. The horizontal lateral was perforated at the following intervals:

| | | |
|---|---|---|
| 8475-77' | 12 JSPF | 24 holes |
| 8220-22' | 12 JSPF | 20 holes |
| 7960-61' | 12 JSPF | 16 holes |
| | Total holes | 60 holes |

After moving the tractor and guns, an isolation tool was installed on the well head. The 5½" casing was then fractured at 130 BPM as recommended in the attached procedure. A flush frac was run as before but the well was not flowed back.

The same procedure was repeated using six 3⅜" casing guns switched for four detonations over two perf clusters (two per cluster) loaded with Baker's Predator charges at 6 JSPF for double-density shots generating 12 JSPF (22 gm charge, 0.47" EHD, 34" penetration) on a wireline tractor system. The frac plug was set at 7770'. The horizontal lateral was perforated at the following intervals:

| | | |
|---|---|---|
| 7670-72' | 12 JSPF | 24 holes |
| 7420-22' | 12 JSPF | 20 holes |
| 7170-71' | 12 JSPF | 16 holes |
| | Total holes | 60 holes |

After pulling the tractor and guns, the 5½" casing was fractured at 130 BPM as recommended in the procedure which follows. A flush frac was run to the top perf. A mud cross NU for flowback and 2" lines and valves were connected to the manifold for flowback to frac tank.

Pump Schedule

1). Pump 10,000 gallons of treated water to load casing and breakdown zone at 10 BPM.

2). Load the wellbore with 3 stages of 1500 gals 15% acid spaced out with 2000 gals of treated water. After acid is loaded, increase rate to bring STP to 5800 psig.

3). Increase rate to 125 BPM and pump a total of 60,000 gallons of Pre-Pad/Acid stage. Step-down 4 rates and SD FOR ISIP & Leak-off Rate if water hammer permits.

4.) Bring pumps back on quickly and pump 200,000 gal pad at 130 BPM with sand slugs as directed by field engineer.

5.) Start 40/70 sand at 0.10 ppg. Increase ppg per schedule subject to maximum surface treating pressure of 6000 psig.

6.) Start 20/40 sand at 0.20 ppg. Increase ppg per schedule subject to maximum surface treating pressure of 6000 psig.

7.) Ramp 20/40 sand from prior ppg to 1 ppg subject to treating characteristics observed during the job.

8.) Flush to the bottom perf with 9,064 gals @ 130 BPM and then back off rate quickly. Do not flow the well back.

9.) RD wellhead isolation & RU lubricator and wireline equipment for next stage perfs.

Treatment Summary

| | | |
|---|---|---|
| Surface Treating Pressure (max) | | 6,073 psi |
| Total Rate (max) | | 130.00 bpm |
| Estimated Pump Time (HH:MM) | | 06:14 |
| Estimated Gross Frac Height | | 335 ft |
| Acid | 4,500 gals | 15% HCL |
| Pad | 255,500 gals | Slick Water |

-continued

| | | |
|---|---|---|
| Proppant | 1,535,000 gals | Slick Water |
| Flush | 9,083 gals | Slick Water |
| Proppants | 312,000 lb | Sand, White, 20/40 |
| | 148,250 lb | Sand, White 40/70 |

Reservoir Data

| | |
|---|---|
| Formation | Barnett Shale |
| Formation Type | Sandy Shale |
| MD Depth to Middle Perforation | 9,034 ft. |
| TVD Depth to Middle Perforation | 6,674 ft. |
| Permeability | 0.00 md |
| Porosity | 3% |
| Fracture Gradient | 0.70 psi/ft |
| Bottom Hole Fracture Pressure | 4,672 psi |
| Bottom Hole Static Temperature | 180° F. |
| Gross Fracture Height | 335 ft |

Perforated Interval

| Depth (ft) | | Shots | | |
|---|---|---|---|---|
| Measured | True Vertical | per Foot | Perf Diameter (in) | Total Perfs |
| 8,765-9,302 | 6,674-6,674 | 0 | 0.42 | 60 |

Total Number of Perforations 60
Total Feet Perforated 537 ft.

| Tubular Geometry | Top | Bottom |
|---|---|---|
| Casing 5½" O.D. (4.892".I.D) 17#<br>Pump Via Casing | 0 | 9,412 |

Fracture Treatment Schedule

Input Parameters

| | |
|---|---|
| TVD Depth (Mid Perforation) | 6,674 ft |
| MD Depth (Mid Perforation) | 9,034 ft |
| Peforations Number | 60 |
| Perforation Diameter | 0.420 in. |
| Bottom Hole Frac Pressure | 4,672 psi |
| Bottom Hole Static Temperature | 180° F. |

| | | | Top | Bottom | |
|---|---|---|---|---|---|
| Casing | 5½" O.D. | (4.892" I.D.) | 17# | 0 | 9,412 |

Calculated Rates, Pressure & HHP Requirements

| | Maximum | Minimum | Average |
|---|---|---|---|
| Surface Treating Pressure (psi) | 6,074 | 5,767 | 5,881 |
| Slurry Rate (bpm) | 130.0 | 130.0 | 130.0 |

-continued

| | Maximum | Minimum | Average |
|---|---|---|---|
| Proppant Rate (lbs/min) | 3,705 | 55 | 1,432 |
| Slurry Hydraulic Horsepower | 19,351 | 18,374 | 18,736 |

An invention has been provided with several advantages. The previously described technique for achieving a shorter perforated interval in combination with the special pumping protocol which has been described better insures that the fracturing fluid being pumped flows more evenly through each set of perforations upon the application of hydraulic pressure rather than the majority of the fluid entering only the first perforated interval of the wellbore. The perforating operation and fracturing protocol allow a predetermined target flow rate to be achieved early on in the pumping operation which flow rate creates a desired backpressure at the perforated intervals in the wellbore, whereby the fracturing fluid more evenly penetrates each perforated interval of the wellbore.

What is claimed is:

1. A method of fracturing a subterranean formation having a deviated well bore penetrating the formation, the method comprising the steps of:

drilling a deviated well bore into the formation;

placing a casing in the deviated well bore;

creating a plurality of spaced fracture initiation points in the well bore within a shortened perforation interval window, whereby a limited known flow rate of fracturing fluid will flow through each set of perforations at the initiation points upon the application of hydraulic pressure;

wherein the shortened perforation interval window is created by shooting the interval more than once to create spaced sets of perforations with a standard perforating gun to thereby achieve a desired number of perforations while minimizing the distance between the spaced sets of perforations;

wherein the method further comprises the steps of:

achieving a target flow rate of fluid being pumped which is selected to create a desired backpressure across each of the sets of perforations in each of the perforated intervals; and wherein the target flow rate is achieved within the first 20 minutes of pumping.

2. The method of claim 1, wherein the target flow rate is at least 100 barrels per minute.

3. A method of fracturing a subterranean formation having a deviated well bore penetrating the formation, the method comprising the steps of:

drilling a substantially vertical well bore into the formation;

drilling a deviated well bore from the substantially vertical well bore into the formation at an angle from the vertical;

placing a casing in the deviated well bore;

creating a plurality of spaced fracture initiation points over a perforation interval in the well bore by forming perforations of a predetermined number and size through the casing from a first to a last set of perforations, whereby a limited known flow rate of fracturing fluid will flow through each set of perforations at the initiation points upon the application of hydraulic pressure;

simultaneously applying hydraulic pressure under a predetermined conditions to all of the sets of perforations at the fracture initiation points to thereby simultaneously form a plurality of spaced substantially parallel fractures in the formation;

wherein each perforation interval is shot more than once with a standard perforating gun to thereby achieve a desired number of perforations while minimizing the distance between the first and last sets of perforations;

wherein said subterranean formation contains hydrocarbons and said fracture initiation points are spaced to obtain maximum hydrocarbon recovery therefrom;

wherein the application of hydraulic pressure to the formation comprises pumping a fracturing fluid into said formation at a rate and pressure sufficient to fracture said formation; and wherein the fracturing fluid is comprised of stages of acid separated by stages of water.

4. The method of claim 3, wherein the fracturing fluid is pumped at a slurry rate of at least 100 barrels per minute achieved within at least the first 20 minutes of pumping.

* * * * *